United States Patent [19]

Jasik

[11] Patent Number: 4,848,586

[45] Date of Patent: Jul. 18, 1989

[54] JEWELRY HOLDING DEVICE

[76] Inventor: Karen A. Jasik, 5122 Sandy Beach Ave., Sarasota, Fla. 34242

[21] Appl. No.: 158,712

[22] Filed: Feb. 22, 1988

[51] Int. Cl.[4] ..... B65D 1/34

[52] U.S. Cl. ..... 206/566; 206/45.14; 206/495; 206/581; 206/45.19

[58] Field of Search ..... 206/45.14, 45.19, 495, 206/566, 570, 574, 575, 581; 220/DIG. 26; 132/294, 314, 315

[56] References Cited

U.S. PATENT DOCUMENTS

| | | | |
|---|---|---|---|
| 1,752,246 | 3/1930 | Flier | 206/566 |
| 2,148,048 | 2/1939 | Gray | 206/45.19 |
| 3,858,718 | 1/1975 | Roy | 206/495 |
| 3,930,576 | 1/1976 | Stephens | 206/45.14 |
| 4,058,215 | 11/1977 | Marchbank | 206/574 |
| 4,099,611 | 7/1978 | Feibelman | 206/45.14 |
| 4,111,341 | 9/1978 | Carrozo | 206/574 |
| 4,181,224 | 1/1980 | Aber | 206/566 |
| 4,371,077 | 2/1983 | Solitt et al. | 206/45.14 |
| 4,413,736 | 11/1983 | Nibling | 206/566 |
| 4,420,084 | 12/1983 | Whelan | 206/566 |
| 4,606,458 | 8/1986 | Labate | 206/566 |
| 4,687,103 | 8/1987 | Corbett | 206/566 |
| 4,697,705 | 10/1987 | Garganesse | 206/566 |
| 4,787,516 | 11/1988 | Morrison | 206/45.14 |

*Primary Examiner*—David T. Fidei
*Attorney, Agent, or Firm*—Charles J. Prescott

[57] ABSTRACT

A jewelry holding device for holding, displaying, and carrying jewelry, particularly in the form of earrings for pierced ears. The device includes a support member connected to a rigid foam member. The support member includes a recess for holding the separate retainer of each earring, while the foam member is adapted to be pierced by the post of each earring and to retain them in that position embedded in the foam member. The foam member may have a cover sheet connected over its exposed, useful surface to prevent deterioration of the foam material. Various forms of the invention are also disclosed.

6 Claims, 3 Drawing Sheets

Fig. 2
Fig. 3
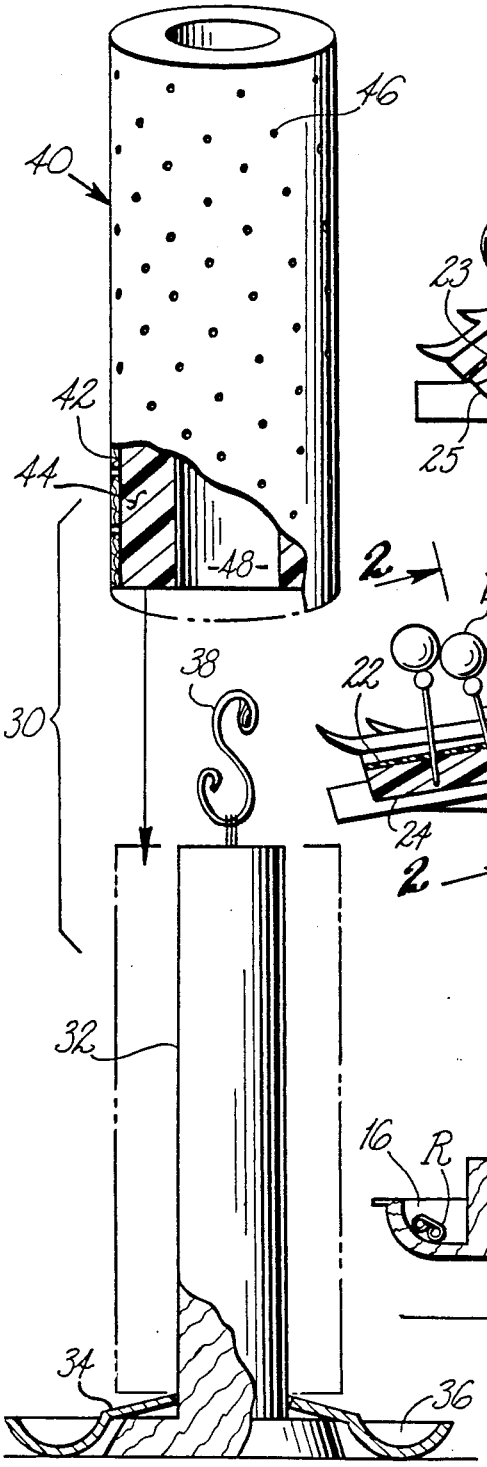
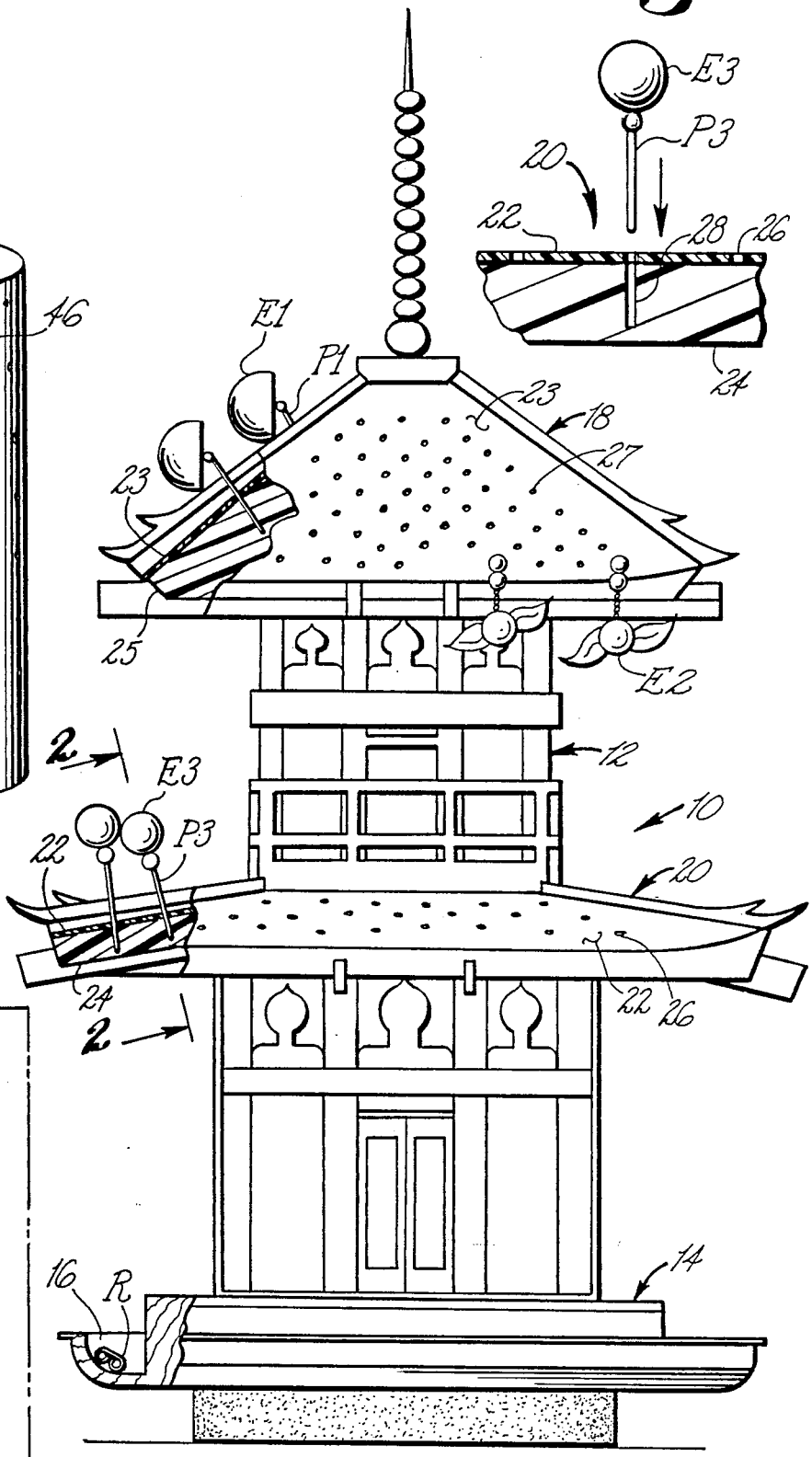
Fig. 1

Fig. 4
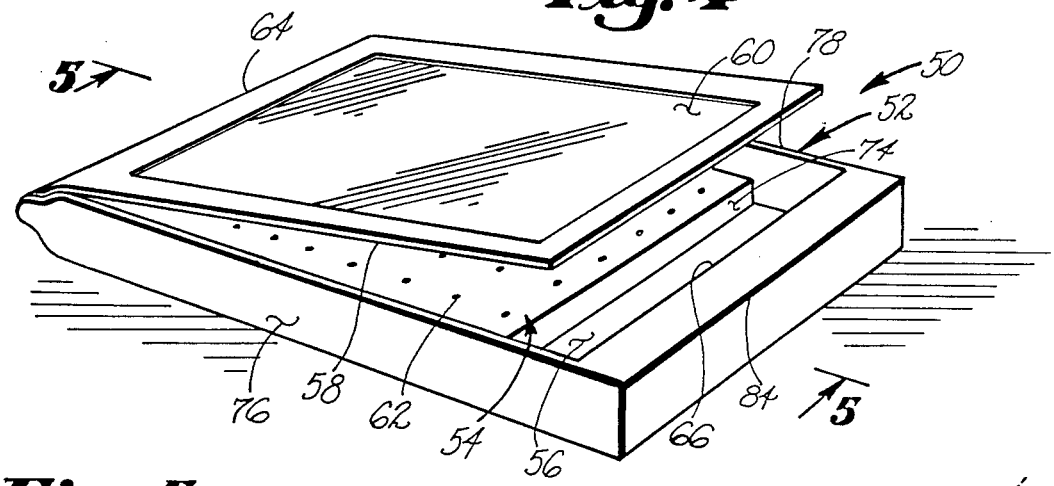
Fig. 5
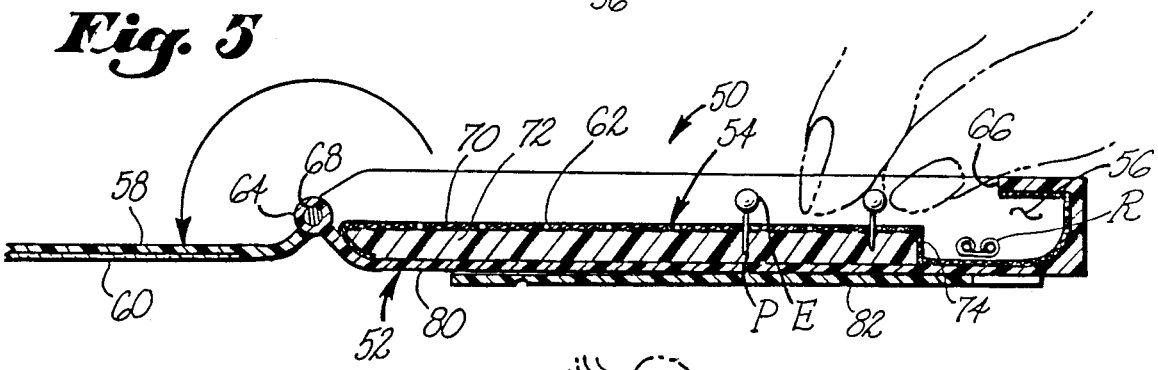
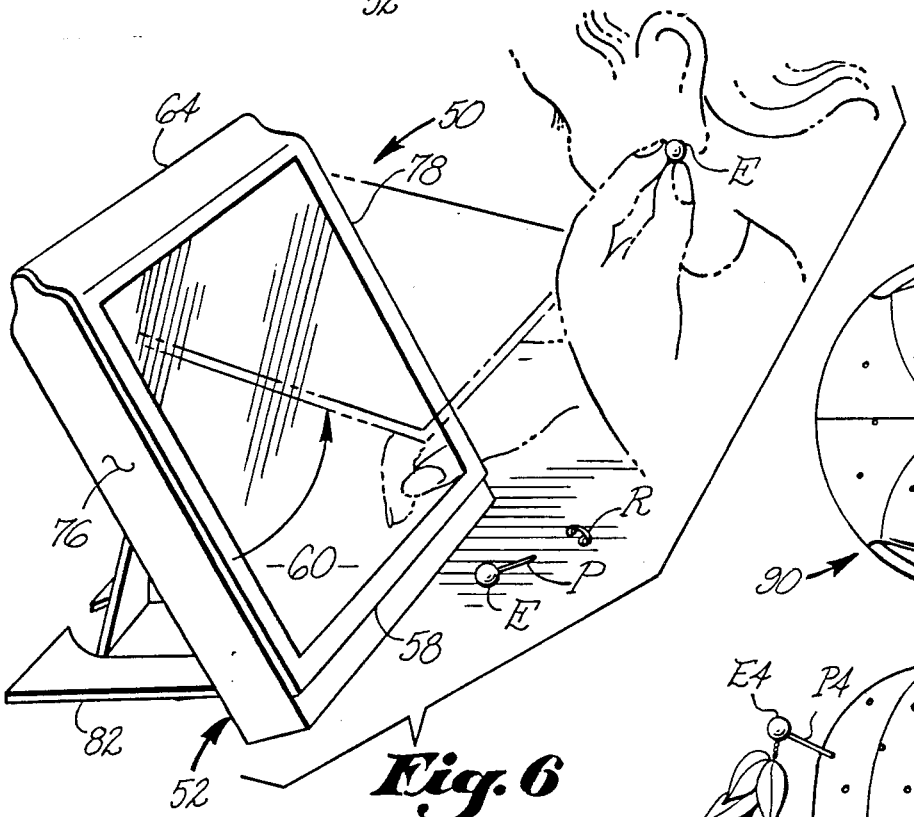
Fig. 6
Fig. 7
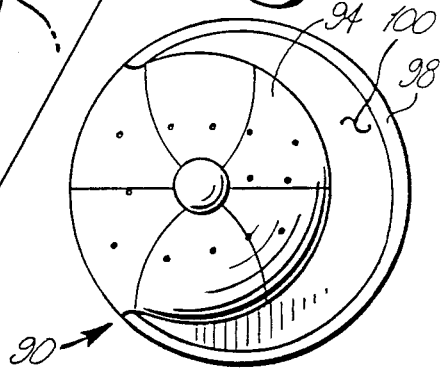
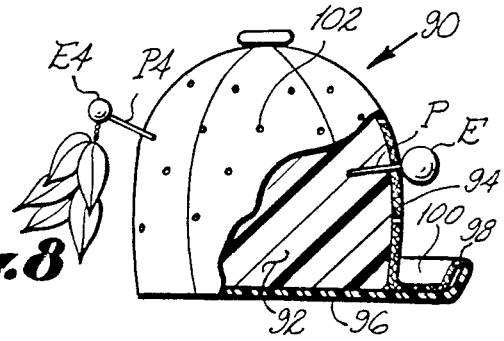
Fig. 8

JEWELRY HOLDING DEVICE

BACKGROUND OF THE INVENTION

This invention relates generally to a jewelry holding device, and more particularly to a device for holding, carrying and displaying earrings for pierced ears.

Earrings for pierced ears are, perhaps, the more popular form of earrings worn currently, typically by women. Such earrings include an exposed ornamental setting which may include a precious stone or metal and having a post or thin elongated shaft extending therefrom. This post is inserted through a previously pierced hole in the ear lobe and, thereafter held in position in the ear by a retainer which is slid onto the post behind the ear lobe. Most individuals who wear jewelry of this nature gradually acquire a collection of different styles and types and then require a container into which to store the collection at home and to transport the jewelry such as while on vacation.

Most conventional jewelry containers available simply provide a cavity, drawer, or box into which the jewelry may be placed, whereupon finding a matching set, along with the associated retainers or viewing the array of earrings in the collection is made quite difficult.

A number of prior art devices are known to applicant which are intended to at least partially overcome these problems. One such device is disclosed in U.S. Pat. No. 4,420,084 to Whelan which discloses a jewelry holding device having at least two frames with a rigid sheet mounted in each of the frames, each sheet having apertures for receiving the earrings. The sheet is relatively thin (a thickness generally equal to the thickness of an ear lobe and intended to merely receive the post of the earrings through the apertures provided to be retained thusly by the retainer attached to the post from the opposite or back side.

Another such jewelry holding device is disclosed in U.S. Pat. No. 4,606,458 to LaBate wherein earrings for pierced ears are held in place by the insertion of the post through a mesh fabric which is held taught within a frame. Retainers are then required to hold the earring in place.

Several other less pertinent prior art inventions are known to applicant, including the jewelry display tray and security system disclosed in U.S. Pat. No. 4,511,041 to Waitzman, the display tray with reversible inserts disclosed in U.S. Pat. No. 4,685,568 to Elsfelder, and the portable display case for timepieces and the like disclosed in U.S. Pat. No. 4,650,077 to Droz.

The present invention is directed to a jewelry holding, carrying and display device which facilitates retention and display of the decorative portion of a pierced earring by the embedding of the post into a relatively thick layer of rigid foam such as Styrofoam. The invention also provides a recessed area for the collection and retention of the separate retainers for pierced earrings. The invention includes various embodiments, including uniquely ornamental embodiments for use in both travel and display.

SUMMARY OF THE INVENTION

The present invention is directed to a jewelry holding device for holding, displaying, and carrying jewelry, particularly in the form of earrings for pierced ears. The device includes a support member connected for holding the separate retainer of each earring, while the foam member, preferably Styrofoam, is adapted to be pierced by the post of each earring and to retain them in that position embedded in the foam member. The foam member may have a thin cover sheet, either flexible fabric or thin plastic sheet, connected over its exposed, useful surface to prevent deterioration of the foam material. Various forms of the invention are also disclosed.

It is therefore an object of this invention to provide a novel jewelry holding device for the storage and display of a plurality of earrings for pierced ears.

It is another object of the above invention to provide a separate recess for the storage of the detachable retainers for pierced earrings.

It is yet another object of the above invention to provide suitable clearance to receive and retain larger pierced earrings.

It is yet another object of the above invention to be provided in several decorative forms which are intended to be placed atop a flat surface or mounted on a wall.

It is yet another object to provide the aove invention with additional features for use.

In accordance with these and other objects which will become apparent hereinafter, the instant invention will now be described with reference to the accompanying drawings in which:

BRIEF DESCRIPTION OF THE DRAWINGS

FIG. 1 is a front elevation view of a uniquely ornamental embodiment of the present invention, the back and side elevation views being substantially identical.

FIG. 2 is an enlarged section view in the direction of arrows 2—2 in FIG. 1.

FIG. 3 is an exploded side elevation partially broken view of another embodiment of the invention.

FIG. 4 is a perspective view of yet another embodiment of the invention.

FIG. 5 is a section view in the direction of arrows 5—5 in FIG. 4.

FIG. 6 is a pictorial view of the embodiment of the invention shown in FIG. 4 in use atop a flat surface.

FIG. 7 is a top plan view of yet another embodiment of the invention.

FIG. 8 is a side elevation partially broken view of the embodiment of the invention as shown in FIG. 7.

DETAILED DESCRIPTION OF THE INVENTION

Figure 9:
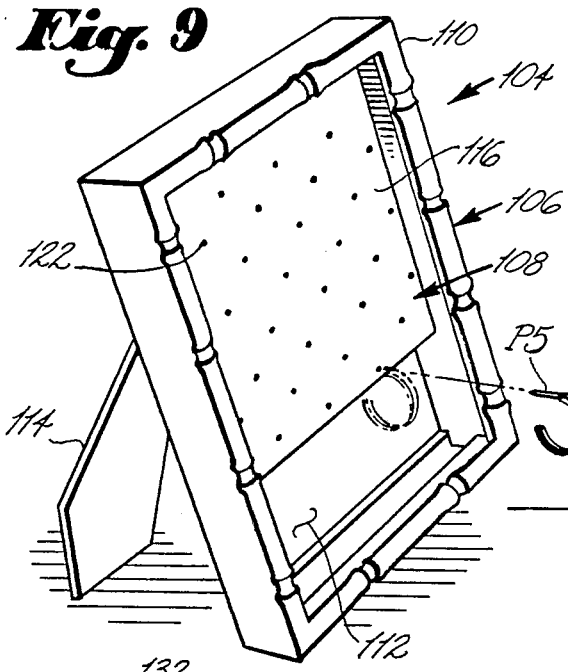
FIG. 9 is a perspective view of yet another embodiment of the invention atop a flat surface.

Referring now to the drawings, and particularly to FIGS. 1 and 2, an ornamental embodiment of the invention is shown generally at 10 having the appearance of a three dimensional miniature model of a pagoda. The pagoda embodiment 10 includes a main upright portion 12 which supports sloping and laterally extended simulated roof sections 18 and 20. The main support 12 includes laterally extending base 14 which is intended to support the device 10 atop a flat surface.

Each of the simulated roof sections 18 and 20 include rigid Styrofoam layers 25 and 24 respectively each having a thin plastic cover sheet 23 and 22 respectively attached and disposed on their outer surface. The cover sheets 22 and 23 include an array of small apertures 26 and 27 respectively which ae sized to receive the posts P1 and P3 of typical pierced earrings E1 and E3. The rigid Styrofoam layer 24 and 25 are adapted, such that when a post P1 or P3 penetrates thereinto, typically a small cavity 28 as best seen in FIG. 2 is formed in the Styrofoam which retains the earring E1 or E3 in place. Therefore, apertures 26 and 27 are not only provided to offer indicia of even placement of a larger quantity of earrings, but also serve to minimize the exageration and deterioration of cavity 28 which is formed in the Styrofoam layer 24 by post P3.

Because the Styrofoam sheet-formed simulated roof sections 18 and 20 extend beyond the main support 12, earring shapes such as shown at E2 which hang below the post which is inserted into the Styrofoam 25, may be readily inserted for displaying and retention in one of the apertures 26 along the lower margin thereof.

Base 14 curves upwardly at its reduced-thickness outer margin to form recess 16 around the periphery thereof, recess 16 being provided to hold and collect the retainers R associated with each pierced earring E1, E2 and E3.

By this arrangement, then, as will also be evident with the other embodiments of the invention described herebelow, not only is a broad range of pierced earrings made conveniently storable, but the user may also quickly and easily view the range of earrings for selection and may also conveniently locate the correct pair of retainers R which can be spread along and viewed within tray 16 more conveniently.

Referring now to FIG. 3, another embodiment of the invention is shown generally at 30 and includes main upright cylindrical support 32 having hanger or carrying hook 38 disposed from its upper end and having a formed metal tray 34 disposed and laterally extending from its lower end. Tray 34, curving concavely upwardly at its peripheral margin forms recess 36 for holding and viewing retainers R as previously described.

Tubular Styrofoam member 44 is adaptedl, having aperture 48 therethrough, to slidably engage over cylindrical support 32. Surrounding the exterior of the cylindrical Styrofoam member 44 is a thin cover layer of fabric 42 which includes an array preformed apertures 46 for receiving the posts of pierced earrings as previously described.

Referring now to FIGS. 4, 5 and 6, another embodiment of the invention is shown generally at 50 adapted to either lay or be supported in picture-frame fashion atop a flat surface and also be closed for transporting jewelry contained therein. This embodiment 50 includes a rigid frame 52 having a back surface 80, side margins 76 and 78 and lower margin 84. Pivotally connected by hinge 68 along its upper margin 64 is closure 58 which includes a mirrored exterior surface 60.

Connected within frame 52 is foam member 54 which includes a rigid Styrofoam sheet 72 covered on its exposed surface by a thin layer of fabric 70. Foam member 54 extends from the upper frame margin 64 toward but not to the lower frame margin 66, ending at 74. By this arrangement, recess 56 is formed therebetween for receiving retainers R. To enhance the anti-spilling feature of this recess 56 when this embodiment 50 is upright, flange 66, upwardly extending, forms a pocket or anti-spill lip as best seen in FIG. 5.

This embodiment 50 also includes a conventional frame support member 82 connected and disposed from back surface 80 to fold out and interengage to support the device 50 in an angular position atop a flat surface as best seen in FIG. 6 for use. When closure 58 is in its closed position, the contents, including earrings E and retainers R are contained and concealed therein. By this arrangement, then, the stylish exterior appearance of this embodiment 50, including mirror 60, presents an unobtrusive and decorative device for containing and facilitating the selection and wearing of these jewelry items.

Referring now to FIGS. 7 and 8, another embodiment of the invention is shown generally at 90 and incorporates the exterior features of a riding hat. With reference to the previous embodiments, the support member and the foam member are incorporated into a single solid Styrofoam portion 92 generally molded to have the exterior shape of the riding hat. Connected atop the exterior surface of the Styrofoamportion 92 is a fabric covering 94 having an array of preformed apertures 102 for receiving the posts P and P4 of earrings E and E4 as previously described. Note that earring E4, having a substantial downwardly hanging portion, is, nonetheless conveniently interengageable for retention and display in one of apertures 102 which are laterally disposed, thus allowing the earring E4 to hang naturally.

The bottom surface of Styrofoam portion 92 is covered with a thin plastic layer 96 which outwardly, then upwardly extends to form a brim 98 of the riding hat 90. Fabric covering 94 extends over the upper surface of the brim 98 to provide a finished appearance to the tray or recess 100 which is formed by this means for collecting and retaining the retainers R of earrings E and E4.

Figure 10:
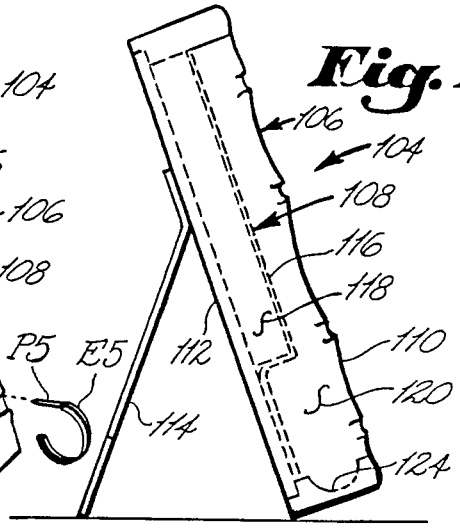
FIG. 10 is a left end elevation view of the invention as shown in FIG. 9.

Referring now to FIGS. 9 and 10, yet another embodiment of the invention is shown generally at 104 in the general form of a shadow box-type free standing picture frame. Indeed, this embodiment 104 includes a conventional shadow box-type picture frame 106 with support 114 disposed from its back surface 112 as shown and previously described.

Connected within the shadow box frame 106 is a foam member 108 having a thin fabric covering 116 disposed over the exterior surface of a layer of Styrofoam 118. Foam member 108 extends from the upper margin of frame 106 down toward, but not to the lower margin of the frame 106. Again, by this arrangement, then recess 120 is formed to receive hanging or unusually shaped earrings E5 whose posts P5 are embedded along one of the lower apertures 122 of the array disposed through cover 116. The lower margin 124 of frame 106 is concaved to reduce the likelihood of spilling retainers R contained in recess 120 while enhancing the user's ability to spread the retainers R over a broader surface for viewing and selection.

Figure 11:
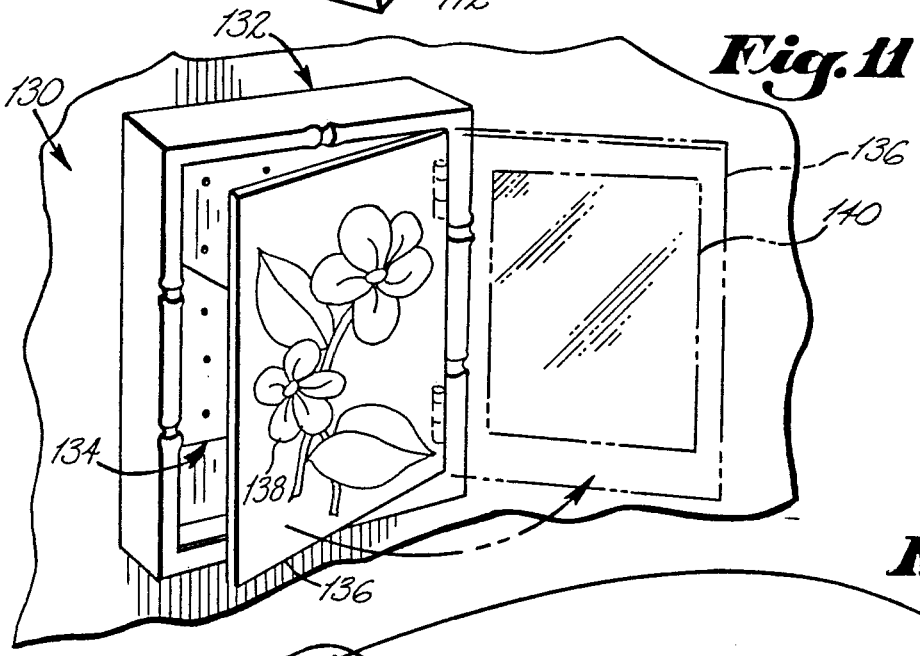
FIG. 11 is a perspective view of yet another embodiment of the invention similar to that shown in FIG. 9.

In another embodiment of the invention shown generally at 130 in FIG. 11, this embodiment 130 adapted to be attached to a vertical surface such as a wall. This embodiment 30 includes frame 132 and foam member 134 in an arrangement and configuration similar to that described with respect to FIGS. 9 and 10. However, this embodiment 130 includes a closure 136 which is pivotally connected along a vertical margin of frame 132. A mirrored surface 140 is provided on the inner surface of closure 136 for use when in its open configuration while the exterior surface may include a decorative design 138 to enhance appearance and to somewhat disguise the contents contained therebehind.

Figure 12:
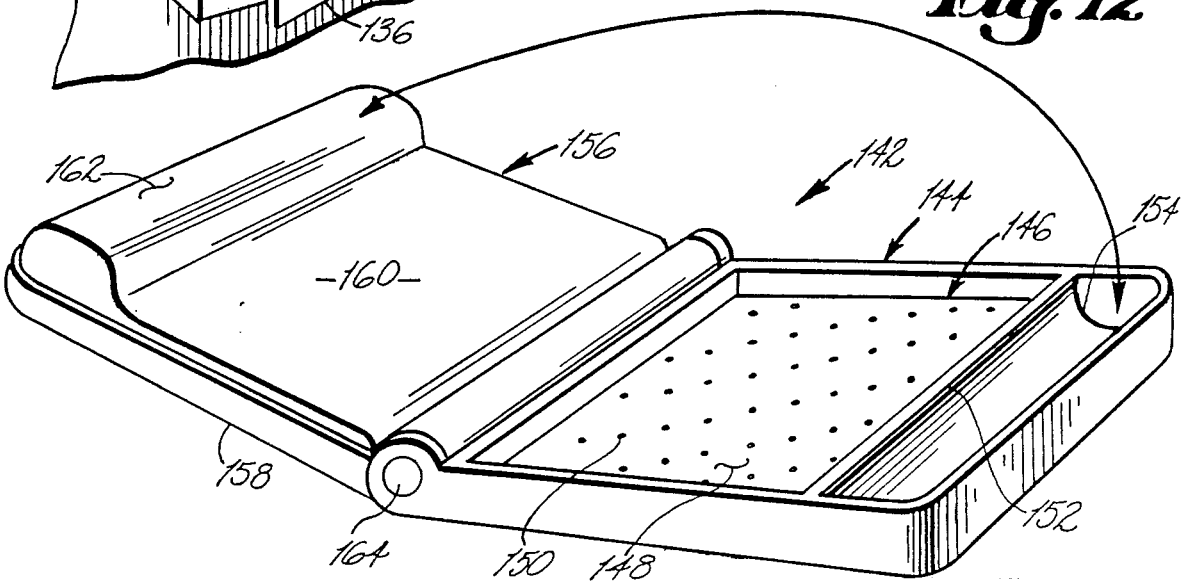
FIG. 12 is a perspective view of yet another embodiment of the invention.

Referring lastly to FIG. 12, an embodiment of the invention for use in carrying and, during traveling, for transporting jewelry is shown generally at 142. This embodiment 142 includes a molded plastic frame 144 pivotally connected along 164 to closure 156. Divider 152 is provided to define recess 154 and to provide a pocket in frame 144 into which foam member 146 is disposed.

Foam member 146 includes a rigid Styrofoam sheet (not shown) having a flexible fabric cover 148 disposed thereover. Here, again, flexible cover 148 includes an array of pre-formed apertures 150 for receiving the posts of pierced earrings and to minimize deterioration of the Styrofoam.

To enhance the anti-spilling feature of this embodiment 142, and to prevent dislodging of both earrings from foam member 148 and retainers from recess 154, closure 156 includes contoured padded member 160. This padded member 160 is somewhat compressible and includes raised portion 162 which mateably engages in recess 154 when closure 156 is in its closed position. Closure 156 includes molded panel 158 which supportively receives padded member 160 connected therein.

Although all of the various embodiments are depicted having a thin flexible or rigid cover disposed over the, preferably Styrofoam member covered therewith, it should be clearly noted that the flexible fabric covering need not include preformed apertures to receive the post of pierced earrings. However, where apertures are not preformed, the fabric should have a weave of sufficient strength and integrity to provide a reasonable degree of lateral stability to the post as it pierces therethrough into the Styrofoam to assist in limiting the deterioration of the Styrofoam under repeated use or movement.

While the instant invention has been shown and described herein in what is conceived to be the most practical and preferred embodiment, it is recognizedd that departures may be made therefrom within the scope of the invention, which is therefore not to be limited to the details disclosed herein, but is to be accorded the full scope of the claims so as to embrace any and all equivalent apparatus and articles.

What is claimed is:

1. A jewelry holding device comprising:

a rigid frame including a perimeter having an upper and a lower margin and a back surface connected to and supporting a rigid foam member having an upper and a lower margin;

said foam member being connected within said perimeter against said back surface and extending along said back surface from said perimeter upper margin toward, but not to, said perimeter lower margin;

said foam member having thickness sufficient to supportively receive a plurality of pierced earrings by insertion of posts of each earring into said foam member;

said foam member lower margin and said perimeter lower margin spaced apart to form a recess against the portion of said back surface not covered by said foam member;

a relatively thin cover sheet disposed and connected over the exposed surface of said foam member;

said recess sized to receive a plurality of detachable retainers of each earring for storage.

2. A jewelry holding device as set forth in claim 1, wherein:

said cover sheet is also relatively nonflexible and includes an array of apertures formed therethrough;

each aperture in said array for receiving one post therethrough.

3. A jewelry holding device as set forth in claim 2, further comprising:

a closure pivotally connected along one edge margin to one edge of said perimeter;

said closure structured to conceal and protect said foam sheet and said recess and earrings and retainers embedded and contained therein respectively.

4. A jewelry holding device as set forth in claim 3, further comprising:

a frame support connected to said frame for holding said device in a relatively upright position atop a flat surface;

a mirror connected to the outer surface of said closure;

said perimeter lower margin having an upwardly extending lip for increasing the depth of said recess;

said closure pivotal connection along said perimeter upper margin.

5. A jewelry holding device as set forth in claim 3, further comprising:

a mirror connected to the inner surface of said closure, the outer surface of said closure adapted to receive artistic and ornamental designs applied thereto;

said closure pivotally connected along one of said perimeter side margins.

6. A jewlery holding device as set forth in claim 3, further comprising:

A pliable, deformable, protective pad connected to the inner surface of said closure;

said protective pad generally deformably mateable against said foam sheet and partially into said recess to prevent dislodgement of earrings from said foam material and spilling of retainers from said recess when said closure is in its closed position against said perimeter.

* * * * *